United States Patent [19]

Karashima

[11] 3,996,763

[45] Dec. 14, 1976

[54] REFRIGERATED SHOW CASE

[76] Inventor: Masashi Karashima, 40-7, Sangenjaya 2-chome, Setagaya, Tokyo, Japan

[22] Filed: Feb. 11, 1975

[21] Appl. No.: 549,039

[30] Foreign Application Priority Data

Dec. 20, 1974 Japan ..... 49-145775

[52] U.S. Cl. ..... 62/256

[51] Int. Cl.[2] ..... A47F 3/04

[58] Field of Search ..... 62/256

[56] References Cited

UNITED STATES PATENTS

| | | | |
|---|---|---|---|
| 2,050,063 | 8/1936 | Millott | 62/256 |
| 3,304,736 | 2/1967 | Brennan | 62/256 |
| 3,369,375 | 2/1968 | Gerweck | 62/256 |
| 3,403,525 | 10/1968 | Beckwith | 62/256 |
| 3,517,526 | 6/1970 | MacMaster | 62/256 |
| 3,528,258 | 9/1970 | Brennan | 62/256 |

*Primary Examiner*—Lloyd L. King
*Attorney, Agent, or Firm*—Wenderoth, Lind & Ponack

[57] ABSTRACT

An improved refrigerating show case is disclosed herein, in which a cold air flow is circulated along its bottom wall, rear wall and top wall and across its front opening to refrigerate the interior of said show case, and another cool air flow is circulated outside of and along the circulating route of said cold air flow to prevent said cold air flow from being warmed up. The improvements exist in that a part of said another cool air flow is diverted upwardly from the top wall portion along its circulating route, whereby the tendency that the room temperature above said refrigerating show case is excessively raised and that on the floor just before said refrigerating show case is excessively lowered, can be eliminated.

2 Claims, 2 Drawing Figures

REFRIGERATED SHOW CASE

Figure 1:
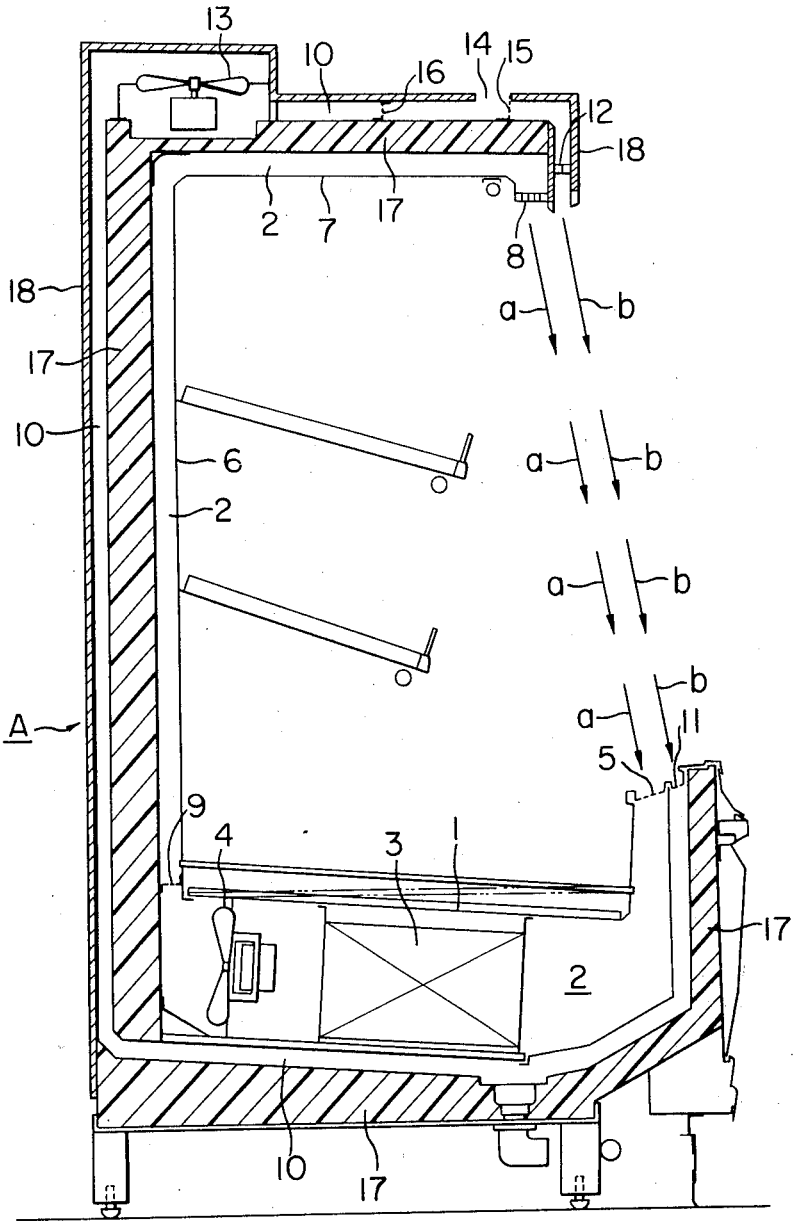

The present invention relates to improvements in a refrigerated show case.

Heretofore, in a refrigerated show case to which the present invention is directed, a cold air flow for refrigerating displayed goods within the show case is circulated across a front opening of the case and along bottom, rear and top walls of the case, and further in order to prevent the cold air flow that is ejected through the upper edge of said front opening and sucked through the lower edge of the same opening from being warmed up upon contacting an ambient atmosphere, another cool air flow is circulated across the front opening of the case and along the bottom, rear and top walls of the case outside of and in parallel to said cold air flow, so that a low temperature air curtain covering the front surface of said cold air flow is formed at the front opening portion of the case.

However, even if the above-described show case is designed in such manner that the flow rate of the cool air flow ejected through the upper edge of the front opening of the show case is equal to the flow rate of the cool air flow sucked through the lower edge of the front opening, the cool flow hydrodynamically interacts with the air in the ambient atmosphere during its passage from the upper ejection edge to the lower suction edge, thus resulting in swirl flows along its passageways across the front opening. Consequently, a part of the cool air flow diverges outside of the refrigerated show case without being sucked through the lower suction edge of the front opening and stagnates in the customers' passageway on the floor in front of the refrigerated show case. The temperature in the customers' passageway is excessively lowered. On the other hand, the ambient temperature near the ceiling of the store where the refrigerated show case is equipped is raised owing to lighting and other heat sources. An excessive temperature difference arises, therefore, between the upper and lower portions of the atmosphere in the store, and only a lower half of the body of a customer standing in the passageway in front of the refrigerating show case is excessively cooled. This is hygienically unfavorable. Also, there is a disadvantage that sales effects are degraded because the customers cannot fully select the goods because of the excessively cooled atmosphere.

The present invention has been proposed to eliminate the above-described disadvantages of the refrigerated show cases in the prior art.

It is one object of the present invention to provide an improved refrigerated show case which can eliminate the excessive temperature difference between the upper and lower portions of the atmosphere in which said refrigerated show case is installed.

According to one feature of the present invention, there is provided a refrigerated show case comprising means for circulating a cold air flow along a bottom wall, rear wall and top wall of said refrigerated show case and across a front opening thereof to refrigerate the interior of said show case, and means for circulating another cool air flow outside of and along the circulating route of said cold air flow to prevent said cold air flow from being warmed up, said means for circulating said another cool air flow including means for diverting upwardly a part of said another cool air flow at the top wall portion along its circulating route.

Since the refrigerated show case according to the present invention is constructed in the above-featured manner, the flow rate of the cool air flow ejected through the upper ejection edge of the front opening of the show case is reduced, so that not only all the cool air flow ejected through the upper ejection edge can be sucked through the lower suction edge, but also the air in the ambient atmosphere outside of the show case is partly sucked. Accordingly, the adverse effect of the cool air flow diverging out of the front opening of the case resulting in a temperature fall of the air in the customers' passageway on the floor in front of the refrigerated show case does not occur.

On the other hand, a part of the cool air flow diverted from the circulating route and ejected upwardly through the top wall of the refrigerated show case is mixed with the air at a raised temperature near the ceiling of the store in which the refrigerated show case is installed, resulting in lowering of temperature and humidity in the store. Also, the mixed air at an intermediate temperature is sucked downwardly through the hydrodynamic interaction with the laminar cool air flow as described above, resulting in a temperature rise and a humidity fall in the customers' passageway. Thus, the temperature difference between the proximity of the ceiling and the customers' passageway is reduced.

As described above, according to the present invention, the temperature fall of the air in the customers' passageway on the floor in front of the refrigerated show case can be prevented, and the temperature difference between the ceiling surface and the floor surface is reduced, so that the subject refrigerated show case never gives cold feelings to the customers standing in the customers' passageway in front of the show case and thus the customers can fully select the goods within the show case. Therefore, the present invention provides a lot of advantages such that the effects of displaying and selling the goods are enhanced.

Figure 2:
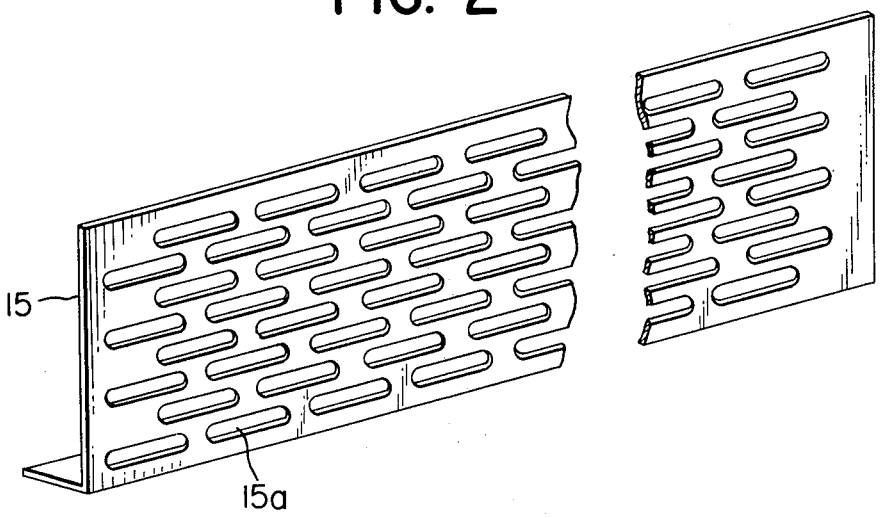

Other features and advantages of the present invention will become apparent upon a perusal of the following specification taken in connection with the accompanying drawings wherein:

FIG. 1 is a schematic longitudinal cross-section view of one preferred embodiment of the refrigerating show case according to the present invention, and FIG. 2 is a perspective view of a perforated baffle plate provided in a cool air flow passageway in the refrigerating show case in FIG. 1.

Referring now to FIG. 1 of the drawings, a refrigerated show case according to the present invention is generally designated by reference A, in which a refrigerator 3 and a fan 4 are contained in a duct 2 of a cold air flow for refrigerating the interior of the show case. The duct is installed within a bottom wall 1 of the show case. A front end of the duct 2 is communicated with a suction port 5 along a lower edge of a front opening of the show case, while a rear end of the duct 2 extends vertically upwards within a rear wall 6 of the show case, further extends horizontally within a top wall 7 of the show case, and is finally communicated with an ejection port 8 along an upper edge of the front opening of the show case. Furthermore, a baffle plate 9 is disposed within the duct 2.

Outside of the duct 2 is another duct 10 of a cool air flow for preventing a temperature rise of the cold air flow for refrigerating the interior of the show case in parallel to the duct 2. A front end of the duct 10 is communicated with a suction port 11 along the lower edge of the front opening of the show case, and a vertical front portion as well as the horizontal bottom portion of the duct 10 is separated from the duct 2 via a partition plate consisting of a heat-conductive material, so that the air sucked into the duct through the suction port 11 is cooled through the heat-conductive partition plate by the cold or refrigerated air flow through the duct 2. The duct 10 further extends vertically upwards from the rear end of its horizontal bottom portion, within the rear wall 6, thereafter extends horizontally within the top wall 7, and is finally communicated with an ejection port 12 along the upper edge of the front opening of the show case. In the portion of the duct 10 within the top wall 7 is a fan 13. In a top surface of the top wall 7 is an opening 14 and along the front edge of the opening 14 is disposed a perforated baffle plate 15 partially intercepting the cool air flow through the duct 10. A more detailed structure of the baffle plate is illustrated in FIG. 2. As seen in FIG. 2, a plurality of horizontal rows of elongated holes 15*a* are formed in the baffle plate 15 in a staggered relationship. Because of the provision of the perforated baffle plate 15, the cool air flow circulated by the fan 13 through the duct 10 and across the front opening of the show case is partly intercepted and diverted upwardly by the baffle plate 15, and thus a part of the main cool air flow is ejected upwardly through the opening 14 towards the ceiling of the store where the refrigerating show case is installed. The remaining part of the cool air flow is passed through the elongated holes 15*a* in the baffle plate 15 and is ejected through the ejection port 12. In one preferred example of operation, about 40% of the main cool air flow through the duct 10 is ejected upwardly through the top surface opening 14, while the remaining portion, i.e., about 60% of the main cool air flow is ejected through the ejection port 12. Another perforated baffle plate 16 is provided in the duct 10 within the top wall 7 for regulating the main cool air flow. Wall members 17 18 are made of a heat-insulating material. In one preferred embodiment, the ratio between the flow rate of the cold air flow through the duct 2 and the flow rate of the main cool air flow through the duct 10 was chosen at 100:80 with a satisfactory result.

In operation, a cold air flow for refrigerating the interior of the show case that is sucked into the duct 2 by means of the fan 4 and refrigerated by the refrigerator 3, passes through the duct portions provided within the bottom wall 1, rear wall 6 and top wall 7, is ejected through the ejection port 8 along the upper edge of the front opening of the show case as shown by arrows *a*, is sucked through the suction port 5 along the lower edge of the front opening of the show case. Thus, the cold air flow is circulated along the bottom wall, rear wall and top wall and across the front opening of the refrigerating show case while refrigerating the goods displayed within the show case.

At the same time, another air flow that is sucked into the other duct 10 through the suction port 11 along the lower edge of the front opening of the show case by means of the fan 13 is cooled by the refrigerator 3 and by the cold air flow in the duct 2 via the heat-conductive partition plate while it passes through the duct portion 10 within the bottom wall 1. Then the cool air flow is further passed through the duct portions 10 within the rear and top walls 6 and 7 by means of the fan 13, and a part of the main cool air flow is diverted by the perforated baffle plate 15 provided in the duct portion 12 within the top wall 7 and is ejected upwardly through the opening 14 on the top surface of the refrigerating show case towards the ceiling, while the remaining part of the main cool air flow passes through the elongated holes 15*a* in the perforated baffle plate 15 and is ejected through the ejection port 12 along the upper edge of the front opening of the show case as shown by arrows *b*. Then, the cool air flow is sucked through the suction port 11 along the lower edge of the front opening of the show case, and thereby it forms across the front opening a low temperature air curtain outside of and adjacent to the laminar flow of the cold air for refrigerating the interior of the show case, so that the cold air flow may not contact with the ambient atmosphere to avoid its temperature rise.

When the top wall 7 of the show case is not provided with the opening 14 leading to the duct 10 as is the case with the present invention, then even if the flow rates of the cold air flow *a* and the cool air flow *b* ejected from the ejection ports 8 and 12, respectively, were to be chosen equal to the flow rates of the same flows *a* and *b* sucked into the suction ports 5 and 11, the cold air flow *a* and the cool air flow *b* would hydrodynamically interact with each other and with the air in the ambient atmosphere during their passage from the upper ejection ports 8 and 12 to the lower suction ports 5 and 11. Consequently, a part of the cool air flow and even a part of the cold air flow would diverge outside of the refrigerating show case without being entirely sucked through the lower suction ports 5 and 11, and stagnate in the customers' passageway on the floor in front of the refrigerating show case, so that the temperature in the customers' passageway is excessively lowered. On the other hand, the ambient temperature near the ceiling of the store where the refrigerated show case is equipped is raised owing to lighting and other heat sources, so that an excessive temperature difference arises between the upper and lower portions of the atmosphere in the store, and the stagnated cold air in the customers' passageway even gives pains to the customers.

However, in operation of the refrigerated show case according to the present invention as illustrated in the drawings and as described above, the opening 14 is provided in the top wall 7 of the show case so as to communicate with the duct 10 of the cool air flow, so that a part of the cool air flow passing through the duct 10 is intercepted and diverted upwardly by the perforated baffle plate 15 and is ejected towards the ceiling as guided by the baffle plate 15 through the opening 14. The remaining part of the cool air flow is passed through the elongated openings 15*a* in the baffle plate 15 and is ejected through the ejection port 12 along the upper edge of the front opening of the show case. As a result, the flow rate of the cool air flow ejected through the ejection port 12 is reduced with respect to that in the case where the opening 14 and the perforated baffle plate are not provided, and thus becomes lower than the flow rate of the cool air flow sucked through the suction port 11 along the lower edge of the front opening of the show case. Accordingly, not only the cool air flow ejected through the ejection port 12 but also the air in the ambient atmosphere is sucked through the suction port 11 into the duct 10, so that the stagnation of the cold or cool air in the customers' passageway is prevented. Furthermore, circulation of the air in the ambient atmosphere outside of the refrigerated show case can be promoted because of the fact that a part of the air in the ambient atmosphere is continuously sucked through the suction port 11.

During this process, the cool air flow ejected upwardly from the opening 14 on the top surface of the refrigerating show case towards the ceiling serves to lower the temperature and humidity of the air in the proximity of the ceiling. As the air in the ambient atmosphere is sucked along the front opening of the show case towards the suction port 12, the air in the proximity of the ceiling is moved downwardly, resulting in reduction of the temperature difference between the floor surface and the ceiling surface of the store where the refrigerating show case is equipped. Therefore, the customers standing in the passageway in front of the refrigerating show case, would not be subjected to an unpleased cold feeling, and they would be able to comfortably choose the goods within the refrigerating show case. Thus, the effects of sales would be enhanced.

Since many changes could be made in the above construction and many apparently widely different embodiments of this invention could be made without departing from the scope thereof, it is intended that all matter contained in the above description or shown in the accompanying drawings shall be interpreted as illustrative and not as limiting.

What is claimed is:

1. A refrigerated showcase comprising:

an upright showcase housing having an open front access thereinto and an opening in the top thereof;

first circulating means within said housing for cooling and circulating a flow of air within the bottom, rear and top walls of said housing and across said open front thereinto, whereby the interior of said showcase is cooled;

second circulating means within said housing adjacent said first circulating means for circulating a second flow of air within the bottom, rear and top walls of said housing and across said open front thereinto in front of the air flow of said first circulating means, whereby the air flow of said first circulating means is prohibited from contacting the ambient air outside the front of said housing, said second circulating means further being connected to said opening in the top of said housing; and diversion means within said second circulating means at the top of said housing for diverting a portion of the air circulating in said second circulation means upward and outward through said opening in the top of said housing, and for limiting the flow of air through said second circulation means, said diversion means being comprised of:

a perforated baffle plate fitted within said second circulation means beneath said opening in the top of said housing, said baffle deflecting a portion of the air flowing through said second circulation means outward through said opening and limiting the flow of air in the second circulation means through the perforations therein.

2. A showcase as claimed in claim 1, wherein said baffle plate perforations reduce the flow of air through said second circulation means by 40%.

* * * * *